US007905734B2

(12) United States Patent
Horiuchi et al.

(10) Patent No.: US 7,905,734 B2
(45) Date of Patent: Mar. 15, 2011

(54) ELECTRONIC DEVICE CONNECTING STRUCTURE AND FUNCTION EXPANSION DEVICE

(75) Inventors: Mitsuo Horiuchi, Sagamihara (JP); Fumio Tamura, Machida (JP); Hiroaki Agata, Yokohama (JP)

(73) Assignee: Lenovo (Singapore) Pte. Ltd., Tech Park (SG)

( * ) Notice: Subject to any disclaimer, the term of this patent is extended or adjusted under 35 U.S.C. 154(b) by 323 days.

(21) Appl. No.: 12/024,902

(22) Filed: Feb. 1, 2008

(65) Prior Publication Data

US 2008/0188125 A1 Aug. 7, 2008

(30) Foreign Application Priority Data

Feb. 5, 2007 (JP) ..... 2007-026036

(51) Int. Cl.
*H01R 13/53* (2006.01)

(52) U.S. Cl. ..... 439/181; 439/924.1; 361/679.41

(58) Field of Classification Search ..... 439/181, 439/924.1; 361/679.41; 710/303, 304
See application file for complete search history.

(56) References Cited

U.S. PATENT DOCUMENTS

| | | | | |
|---|---|---|---|---|
| 5,557,562 | A * | 9/1996 | Yoshiharu et al. | 361/679.41 |
| 5,673,172 | A * | 9/1997 | Hastings et al. | 361/679.34 |
| 6,049,453 | A * | 4/2000 | Hulsebosch | 361/679.41 |
| 6,241,537 | B1 * | 6/2001 | Tate et al. | 439/108 |
| 7,044,794 | B2 * | 5/2006 | Consoli et al. | 439/607.07 |
| 7,064,949 | B2 * | 6/2006 | Chagny et al. | 361/220 |
| 7,404,724 | B1 * | 7/2008 | Miller | 439/181 |

FOREIGN PATENT DOCUMENTS

| | | |
|---|---|---|
| JP | 5-77899 | 10/1993 |
| JP | 7-84689 | 3/1995 |

* cited by examiner

*Primary Examiner* — Xuong M Chung Trans
(74) *Attorney, Agent, or Firm* — Kunzler Needham Massey & Thorpe

(57) ABSTRACT

A connecting structure reduces noise effects on an electronic device when hot docking the electronic device to mitigate against malfunctions. When a first electronic device having a first EMI shield is docked with a second electronic device having a second EMI shield, an ESD contact portion, which is connected to the second EMI shield and has higher in impedance than an EMI connecting portion, comes in contact with the first EMI shield earlier than the EMI connecting portion. Electrostatic charge carried on the first EMI shield moves slowly to the second EMI shield due to the high impedance of the ESD contact portion.

10 Claims, 4 Drawing Sheets

ELECTRONIC DEVICE CONNECTING STRUCTURE AND FUNCTION EXPANSION DEVICE

CROSS-REFERENCES TO RELATED APPLICATIONS

This application claims priority to the Japanese Patent Application Serial Number 2007-026036 entitled "ELECTRONIC DEVICE CONNECTION STRUCTURE AND FUNCTION EXPANSION DEVICE" and filed on Feb. 5, 2007 for Hiroaki Agata et al., which is incorporated herein by reference.

BACKEARTH OF THE INVENTION

1. Field of the Invention

The present invention generally relates to a technique of reducing interference occurring in signal lines when connecting electronic devices, each of which is electromagnetically shielded, to each other.

2. Description of the Related Art

A notebook computer (hereinafter, referred to as a 'notebook PC') is very portability since the notebook PC is small and light, but the notebook PC has a slightly limited functionality compared with a desktop computer. To expand the functionality of a notebook PC when using the notebook PC in an office or a house, a function expansion device called a docking station is adopted. The function expansion device may be provided with storage devices, such as a CD-ROM drive and a hard disk drive, connecting terminals, such as a serial port, a parallel port, and a USB, expansion slots of various kinds of buses, and the like. In addition, by connecting a notebook PC to a function expansion device with a connector, desktop computer functions can be enjoyed and the complications of connecting to a network, a printer, and the like can be avoided. A function expansion device including only connecting terminals, such as a serial port, a parallel port, a USB port, an external display output connector, and a connector for a printer, is commonly referred to as a port replicator.

Since the notebook PC and the function expansion device accommodate electronic devices employing high-frequency signals, electromagnetic waves are emitted from the notebook PC and the function expansion device. In addition, the notebook PC and the function expansion device may be easily affected by electromagnetic waves introduced from the outside. Therefore, in the notebook PC and the function expansion device, electromagnetic shielding is typically used to prevent electromagnetic interference (EMI). Hereinafter, the electromagnetic shielding is referred to as an EMI shield. The EMI shield covers an electronic device with a thin plate formed of a conductive material, such as aluminum or copper, that reflects or absorbs electromagnetic waves emitted from the inside and electromagnetic waves introduced from the outside, so that that the electromagnetic waves emitted from the inside and the electromagnetic waves introduced from the outside do not pass through the EMI shield.

A circuit in the notebook PC and the function expansion device is typically configured to include a signal line through which a high-frequency pulse signal flows and a signal earth line which serves to apply a reference potential to the signal line. Since the EMI shield applies a common reference potential to various electronic devices of the notebook PC and the function expansion device, and the signal earth line of each electronic device is connected to the EMI shield. The notebook PC and the expansion device are provided with interface connectors used for connection therebetween, and each signal line and each signal earth line are connected to the corresponding interface connector.

In case where a signal earth line is connected to a corresponding EMI shield, an EMI shield of a notebook PC and an EMI shield of a function expansion device are electrically connected to each other through the signal earth lines when the notebook PC and the function expansion device are connected to each other with interface connectors. However, it is difficult to make the EMI shields have the same electric potential during an operation of the notebook PC by only connecting the signal earth lines to each other.

The resistance of a notebook PC to noise tends to decrease as an operating frequency of the notebook PC increases and an operating voltage of the notebook PC decreases. In addition, electric resistance tends to increase as an EMI shield becomes thinner for reduction in weight. As a result, a connecting structure of a notebook PC and/or a function expansion device may function as a lightning rod, causing the notebook PC may malfunction due to aerial discharge of electrostatic charge when hot docking the notebook PC.

FIG. 5 is a schematic block diagram illustrating a malfunction when a notebook PC is docked with a docking station function expansion device. A notebook PC 10 includes an EMI shield 113, and a docking station 50 includes an EMI shield 143. A mother board 115 and an electronic device 117 are accommodated inside the EMI shield 113, and an electronic device 145 is accommodated inside the EMI shield 143. Circuit elements 125 and 127 are mounted on the mother board 115, a circuit element 129 is mounted on the electronic device 117, and a circuit element 155 is mounted in the electronic device 145.

A signal line 121 and a signal earth line 123 of the circuit elements 125 and 127 are connected to an interface connector (hereinafter, referred to as a 'connector') 15. A signal line and a signal earth line of the circuit element 129 are connected to the signal line 121 and the signal earth line 123 of the mother board. The signal earth line of the circuit element 129 is also connected to the EMI shield 113. A signal line 149 and a signal earth line 151 of the circuit element 155 are connected to a connector 55. The signal earth line 123 is connected to the EMI shield 113, and the signal earth line 151 is connected to the EMI shields 141. When a housing (not shown in FIG. 5) provided outside each of the EMI shields 113 and 143 is a conductor, the housing and each of the EMI shields 113 and 143 are electrically connected to each other. EMI connecting protrusions 59*a* and 59*b* and lightning protrusions 157*a* and 157*b* are provided in the EMI shield 143.

When the connector 15 and the connector 55 are brought closer to each other in order to hot dock the notebook PC 10, on which electrostatic charge is carried, with the docking station 50, the electrostatic charge is discharged through a space between the lightning protrusions 157*a* and 157*b* and the EMI shield 113. The discharge of the electrostatic charge is referred to herein as electrostatic discharge (ESD). When the ESD is through the air, a rapid movement of electric charges occurs. As a result, a convection current flows in the air and a conduction current flows in the EMI shield 113 of the notebook PC 10. Since the conduction current is an impulse-shaped large current, a harmonic component is included. Accordingly, an inductive reactance of the EMI shield 113 also acts as large impedance. As a result, a local fluctuation in electric potential occurs in the EMI shield 113 due to impedances 131 and 133 each having resistance and inductive reactance.

In addition, due to electrostatic coupling or electromagnetic coupling between the EMI shield 113 and the signal line 121, noise is introduced into the signal line 121 so that a reference potential of the circuit element 129 is changed. Moreover, since harmonic components are also included in a convection current, electromagnetic wave noise is generated also from an aerial discharge portion. As a result, the notebook PC 10 may malfunction. Furthermore, depending on the position of the notebook PC when connecting the notebook PC 10 and the docking station 50, the EMI connecting protrusions 59*a* and 59*b* may be brought closer to the EMI shield 113 earlier than the lightning protrusions 157*a* and 157*b* such that the electrostatic charge between the EMI connecting protrusions 59*a* and 59*b* is discharged through the air, causing a malfunction while hot docking the notebook PC 10.

A user who uses a notebook PC in an office may perform so-called hot docking, that is, may connect the notebook PC to a function expansion device when power is not turned off, such as when the user comes back to the desk after using the notebook PC in the meeting. At this time, the notebook PC is electrically charged with static electricity from the user holding the notebook PC, and accordingly, an electrostatic charge is generated. When the notebook PC on which electrostatic charge is accumulated is hot docked to the function expansion device, ESD occurs between interface connectors when the notebook PC and the function expansion device are brought close to each other. As a result, a discharge current flows through a signal earth line or a signal line, which may cause the notebook PC to malfunction.

SUMMARY OF THE INVENTION

From the foregoing discussion, there is a need for a method or preventing ESD related malfunction when hot docking an electronic device. The present invention mitigates against ESD related malfunction when hot docking.

A connecting structure of a second electronic device includes a second EMI shield, a second signal line, a second signal earth line, and EMI connection portion, and an ESD contact portion. The second signal line is enclosed by the second EMI shield and connected to a first signal line when hot docking with a first electronic device. The first electronic device includes a first EMI shield, a processor enclosed by the first EMI shield, the first signal line enclosed by the first EMI shield and connected to the processor, and the first signal earth line enclosed by the first EMI shield and connected to the processor.

The second signal earth line is enclosed by the second EMI shield and connected to the first signal earth line when hot docking. The EMI connecting portion is connected to the second EMI shield and comprises a conductor connected to the first EMI shield when hot docking. The ESD contact portion is connected to the second EMI shield. In addition, the ESD contact portion is higher in impedance than the EMI connecting portion, and comes in contact with the first EMI shield earlier than the EMI connecting portion when hot docking.

References throughout this specification to features, advantages, or similar language do not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The present invention mitigates the effects of ESD during hot docking. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
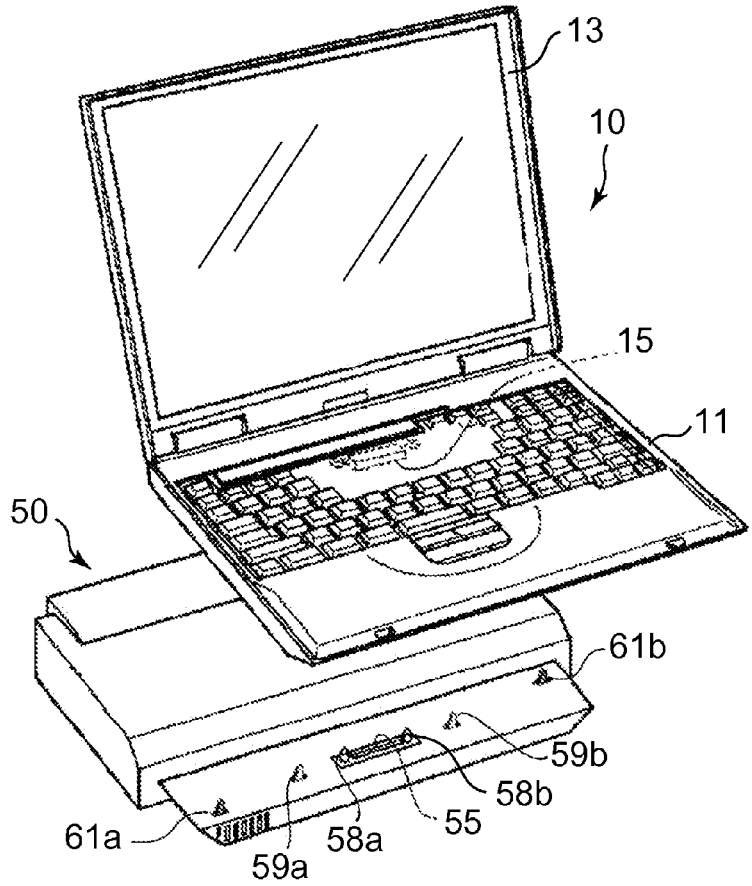
FIG. 1 is a perspective drawing illustrating the appearance and the configuration of a notebook PC and a docking station (function expansion device) according to an embodiment of the present invention.

In the present invention, an electrical connection structure is provided that mitigates ESD when hot docking a first electronic device and a second electronic device with each other. Hot docking refers to connecting signal lines and signal earth lines of the first and second electronic devices to each other when the power of at least one of the first electronic device and the second electronic device is turned on. The first electronic device and the second electronic device are electromagnetically shielded by a first EMI shield and a second EMI shield, respectively. The first electronic device is provided with a processor to which the signal line and the signal earth line are connected and that emits electromagnetic waves. The EMI shield serves to suppress the discharge and introduction of electromagnetic waves by covering the periphery of the signal line and the signal earth line. The EMI shield may be formed of a thin conductive plate separated from a housing. Alternatively, the EMI shield may be formed by using a conductive housing or by coating a housing formed of a synthetic resin with conductive coating compound. Instead of the thin conductive plate, a mesh structure may be adopted. Although it is preferable to completely cover a signal line and a signal earth line in order to be effective as an EMI shield, an open portion may exist, for example, in a place where discharge of electromagnetic waves is small or in a place which is not easily affected by electromagnetic waves. In addition, the EMI shield may be connected to the earth having an earth level or may not be connected thereto. In case where the EMI shield is connected to the earth, the EMI shield has both functions of electromagnetic shielding and electrostatic shielding.

When the first electronic device and the second electronic device are electrically connected to each other, it is not possible to maintain the first EMI shield and the second EMI shield at the same electric potential with respect to a high-frequency current only by connecting the signal earth lines to each other. Accordingly, in order to suppress a displacement current caused by an electromagnetic wave generated due to an operation of the processor, it is necessary to perform an EMI connection between the first EMI shield and the second EMI shield. An EMI connecting portion used to perform the EMI connection has an electrically reliable connecting structure so that the first EMI shield and the second EMI shield can be maintained at the same electric potential with respect to a high-frequency current while the first electronic device and the second electronic device are being connected to each other in operative communication. In case where it is not possible to make impedances of the first EMI shield and the second EMI shield, which extend in plain view, small, it is preferable to perform the EMI connection in a plurality of positions.

The ESD contact portion is connected to the second EMI shield, is higher in impedance than the EMI connecting portion, and first comes in contact with the first EMI shield at the time of hot docking. A conduction current generated by the movement of electrostatic charge includes many harmonic components. Accordingly, in order to suppress a current caused by ESD, impedance of the ESD contact portion is set to high impedance with respect to a harmonic current. The impedance value needs to be a large value to the extent that aerial discharge does not occur when a user holds the first electronic device. It is preferable to increase the impedance value because the peak of a conduction current generated by discharge is decreased. However, electrostatic charge needs to be sufficiently discharged in a short period of time until EMI connection performed subsequent to ESD contact. This is because interference caused by ESD at the time of EMI connection may occur if sufficient discharge is not completed at the time of the EMI connection.

Since the conduction current generated by ESD includes a harmonic component, the ESD contact portion may also be constituted by an element equivalent to inductive reactance. The inductive reactance may have some resistance which is equivalently connected in series thereto. The ESD contact portion may be electrically separated from the first EMI shield after the ESD contact portion comes in contact with the first EMI shield so as to discharge electrostatic charge. Here, the term of 'contact' of the ESD contact portion is used to indicate that a continuous connection is not needed after ESD is completed, and the term of 'connection' of the EMI connecting portion is used to indicate that a continuously reliable connection is needed.

By adopting such a structure, the ESD contact portion comes in contact with the first EMI shield at the time of hot docking such that the electrostatic charge flows as a slow conduction current, even if the first electronic device is electrically charged with electrostatic charge. As a result, since a peak value of a current flowing through the first EMI shield is suppressed, it is possible to reduce a local fluctuation in electric potential of the first EMI shield and to prevent noise from being introduced to the first signal line due to electrostatic coupling or electromagnetic coupling. Accordingly, a malfunction caused by noise does not occur even if the first and second electronic devices hot docked.

Furthermore, even in case where the first EMI shield or the second EMI shield applies a reference potential to the first electronic device or the second electronic device, respectively, operation failure caused by a fluctuation in the electric potential of a signal earth line does not occur even if multi-point earth is adopted because a fluctuation in reference potential is small. After the ESD contact portion first comes in contact with the first EMI shield, connection between the EMI connecting portion and the first EMI shield and connection between the first signal earth line and the second signal earth line are performed at the same time or one of the connections is first performed. However, in the embodiment of hot docking, stable connection can be performed when connection between signal earth lines is performed earlier than connection between signal lines.

In an embodiment where a signal line and a signal earth line are connected to an interface connector, the EMI connecting portion is provided at the positions apart from the interface connector in a plural number so that noise cause by ESD is not introduced from the interface connector, and the first EMI shield and the second EMI shield are connected to each other such that an impedance is low compared with a high-frequency current which emits an electromagnetic wave.

The ESD contact portion and the EMI connecting portion may be provided in different locations if the ESD contact portion first comes in contact with the first EMI shield when hot docking the first electronic device and the second electronic device with each other. However, if the ESD contact portion and the EMI connecting portion are provided in different locations, discharge of electrostatic charge may be first performed in the EMI connecting portion due to the position of the first electronic device at the time of hot docking. In order to prevent this, it is desirable to form the ESD contact portion and the EMI connecting portion in the same location of second electronic device. As an example, the first electronic device and the second electronic device may be constituted as a portable computer and a function expansion device, respectively.

Figure 5:
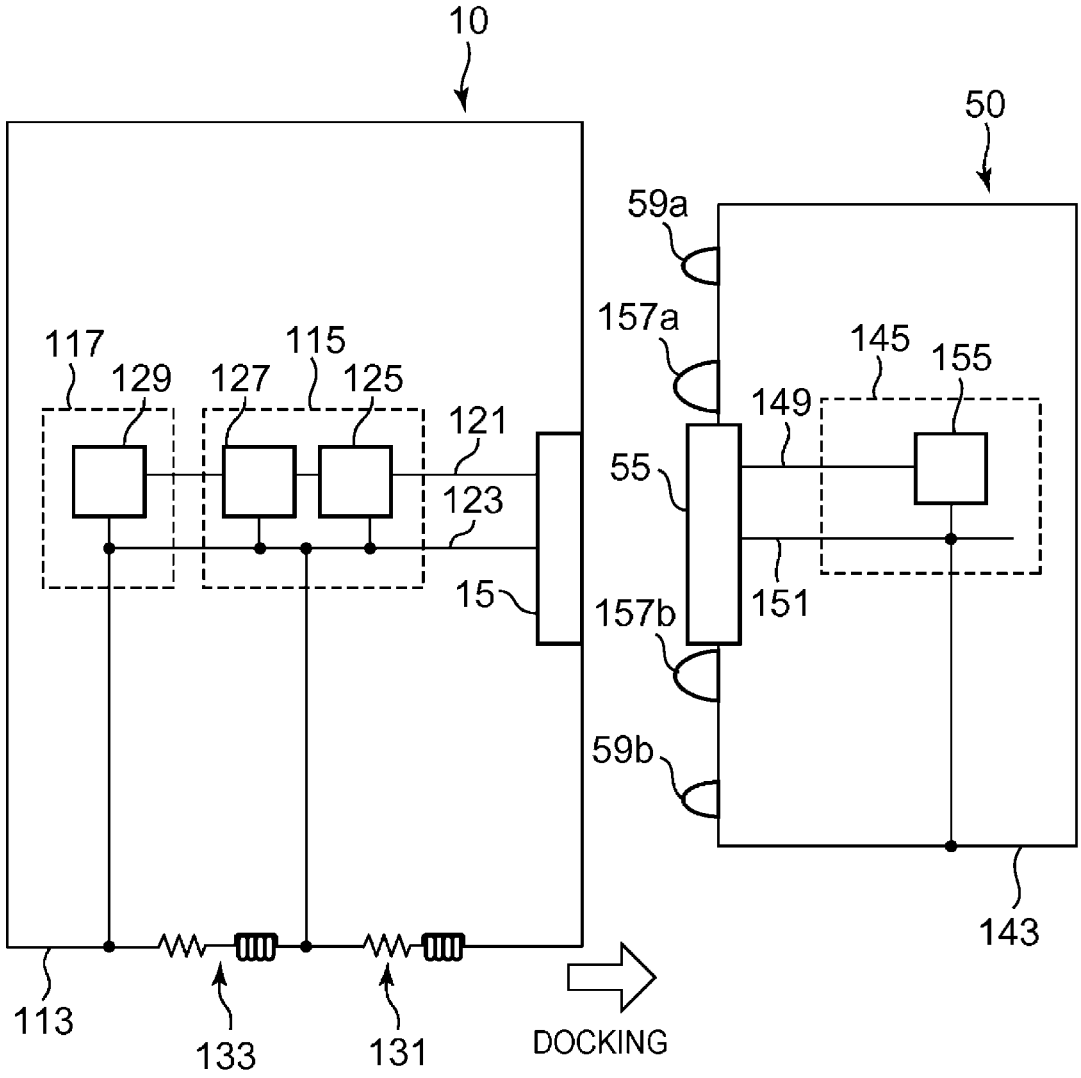
FIG. 5 is a circuit illustrating the occurrence of a malfunction when a notebook PC is docked with a docking station.

FIG. 1 is a perspective illustrating the appearance and the configuration of a notebook PC 10 and a docking station 50 according to an embodiment of the present invention. The docking station 50 is an embodiment of a function expansion device. In FIG. 1, the elements of FIG. 5 are denoted by the same reference numerals. The notebook PC 10 is configured to include a main housing 11, which has a surface on which a keyboard and a pointing device are mounted and has many kinds of devices accommodated therein, and a lid 13 having a surface on which a liquid crystal display (LCD) is mounted. The housing may be formed of a synthetic resin having large electric resistance. The notebook PC 10 may be mounted on the docking station 50 by hot docking. In the hot docking, the notebook PC 10 and the docking station are connected to each other in a state where either the notebook PC 10 or the docking station are activated with power supplied thereto. A function of the notebook PC 10 can be expanded by connecting the connector 15, which is located on a bottom surface of the housing 11 of the notebook PC 10, to the connector 55 which is located on an upper surface of the docking station 50. When the lid 13 is opened in a state where the notebook PC 10 is connected to the docking station 50, it is possible to use the LCD, the keyboard, and the pointing device built in the notebook PC 10. In addition, if an external display (not shown), an external keyboard (not shown), and a mouse (not shown) are connected to the docking station 50, the notebook PC 10 may also be used together with a high-performance display, which is larger than the LCD built in the notebook PC 10, and user-friendly keyboard and mouse in a state where the lid 13 of the notebook PC 10 is closed.

Circuit boards and electronic devices which are accommodated inside the notebook PC 10 and the docking station 50 are covered by EMI shields (not shown in FIG. 1) formed of a conductor for electromagnetic shielding. Each of the EMI shields has a structure that covers electronic devices and/or circuit boards provided therein from all directions but partially opened in a range which cannot be closed for design reasons. Guides 58*a* and 58*b* matching the positions of the connector 15 and the connector 55 are provided at both ends of the connector 55 on a side of the docking station 50. The guides 58*a* and 58*b* fit to guide holes (not shown), which are formed at both ends of the connector 15, when the notebook PC 10 is docked with the docking station 50. On the upper surface of the docking station 50, EMI connecting protrusions 59*a* and 59*b* used to electrically connect an EMI shield on a side of the notebook PC with an EMI shield on a side of the docking station, are provided separately from the connector 55. On the bottom surface of the housing 11 of the notebook PC 10, the positions corresponding to the EMI connecting protrusions 59*a* and 59*b* are opened to expose the EMI shield, such that the EMI shield is connected to tips of the EMI connecting protrusions 59*a* and 59*b* at the time of docking. In addition, ESD contact protrusions 61*a* and 61*b* are provided on the upper surface of the docking station. On the bottom surface of the housing 11 of the notebook PC 10, the positions corresponding to the ESD contact protrusions 61*a* and 61*b* are opened to expose the EMI shield, such that the EMI shield is connected to tips of the ESD contact protrusions 61*a* and 61*b* when docking.

The EMI connecting protrusions 59*a* and 59*b* and the ESD contact protrusions 61*a* and 61*b* are electrically connected to the EMI shield of the docking station 50 and are elastically supported by the EMI shield of the docking station 50, such that the EMI connecting protrusions 59*a* and 59*b* and the ESD contact protrusions 61*a* and 61*b* elastically sink into the docking station when tips of the EMI connecting protrusions 59*a* and 59*b* and the ESD contact protrusions 61*a* and 61*b* come in contact with the EMI shield of the notebook PC 10. The EMI connecting protrusions 59*a* and 59*b*, the ESD contact protrusions 61*a* and 61*b*, and the connector 55 are arranged in the order of the ESD contact protrusion 61*a*, the EMI connecting protrusion 59*a*, the connector 55, the EMI connecting protrusion 59*b*, and the ESD contact protrusion 61*b* from left to right as viewed from the front of the notebook PC 10. In addition, as viewed from the front of the notebook PC 10, the EMI connecting protrusions 59*a* and 59*b* and the connector 55 are located on an approximately horizontal line, but the ESD contact protrusion 61*a* is arranged slightly forward from the EMI connecting protrusions 59*a* and 59*b* and the connector 55 and the ESD contact protrusion 61*b* is arranged slightly backward from the EMI connecting protrusions 59*a* and 59*b* and the connector 55. The ESD contact protrusions 61*a* and 61*b* protrude beyond the upper surface of the docking station 50 such that the heights of protrusions of the ESD contact protrusions 61*a* and 61*b* are larger than those of protrusions of the EMI connecting protrusions 59*a* and 59*b*. In this structure, when the notebook PC 10 and the docking station 50 are combined, the EMI shield of the notebook PC 10 and the ESD contact protrusions 61*a* and 61*b* first come in contact with each other, and then the EMI shield of the notebook PC 10 and the EMI connecting protrusions 59*a* and 59*b* are connected to each other.

Figure 2:
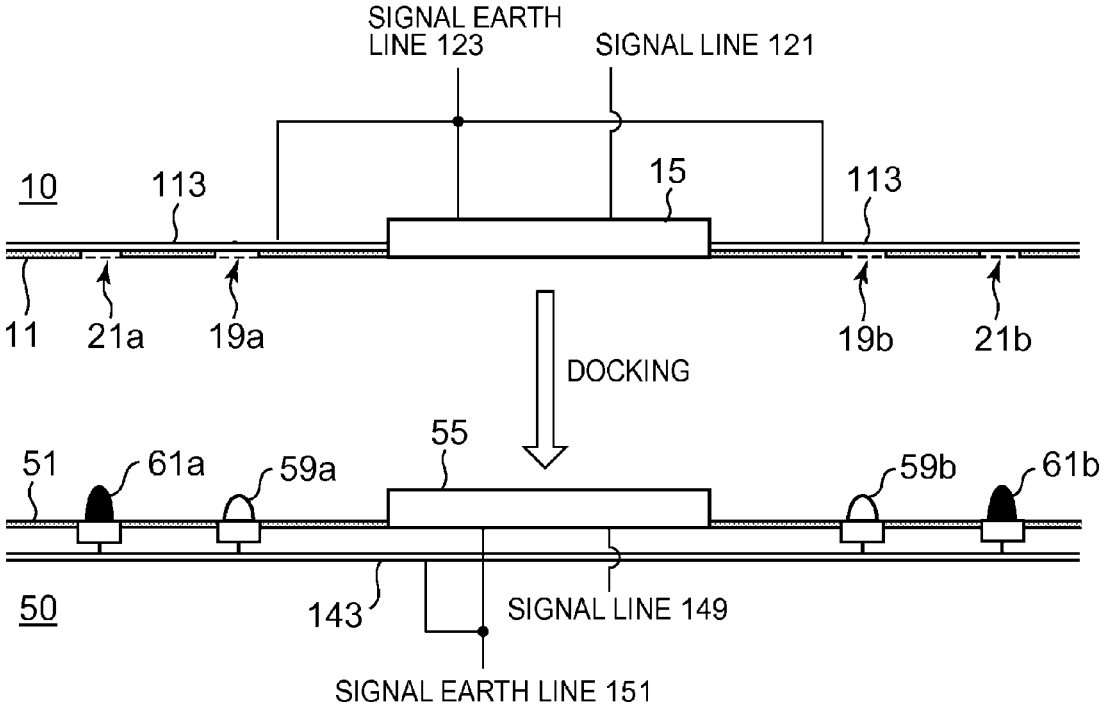
FIG. 2 is a conceptual drawing illustrating connection states of EMI connecting protrusions, ESD contact protrusions, and connectors when a notebook PC is docked with a docking station in an embodiment of the present invention.

FIG. 2 is a conceptual drawing illustrating connection states of the EMI connecting protrusions 59A and 59b, the ESD contact protrusions 61*a* and 61*b*, and the connectors 15 and 55 when the notebook PC 10 is docked with the docking station 50. In FIG. 2, the same components as in FIGS. 1 and 5 are denoted by the same reference numerals. FIG. 2 conceptually illustrates a cross section of a peripheral portion of each of the connectors located on the bottom surface of the notebook PC 10 and the upper surface of the docking station 50. On the bottom surface of the notebook PC 10, there is shown a state where a part of the housing 11 is opened to expose an EMI shield 113 such that the EMI shield 113 becomes ESD contact portions 21*a* and 21*b* and EMI connecting portions 19*a* and 19*b*. When the notebook PC 10 is docked with the docking station 50, the connector 15 and the connector 55 are connected to each other, and at the same time, the tips of the EMI connecting protrusions 59*a* and 59*b* bump the EMI connecting portions 19*a* and 19*b* and the EMI shield 113 and an EMI shield 143 are electrically connected to each other. In addition, the tips of the ESD contact protrusions 61*a* and 61*b* come in contact with the ESD contact portions 21*a* and 21*b*, such that ESD occurs between the EMI shield 113 and the EMI shield 143.

On the docking station 50, a signal line 149 and a signal earth line 151 are connected to the connector 55. The signal line 149 and the signal earth line 151 are typically configured to include a plurality of lines. The EMI connecting protrusions 59*a* and 59*a*, the ESD contact protrusions 61*a* and 61*b*, and the signal earth line 151 are connected to the EMI shield 143. On a side of the notebook PC 10, a signal line 121 and a signal earth line 123 are connected to the connector 15, and the signal earth line 123 is connected to the EMI shield 113.

All of the EMI shield 113, the EMI shield 143, and the EMI connecting protrusions 59*a* and 59*b* are formed of a good conductor, such as a metal. Accordingly, the EMI connecting protrusions 59*a* and 59*b* and the EMI shield 113 are electrically connected to each other through a low-impedance conductor. As a result, since the EMI shield 113 and the EMI shield 143 are electrically connected to each other through a low-impedance conductor, it is possible to prevent electromagnetic waves from radiating from the notebook PC 10 and the docking station 50 while the notebook PC 10 is being docked with the docking station 50. However, parts of the ESD contact protrusions 61*a* and 61*b* being in contact with the ESD contact portions 21*a* and 21*b* are formed of a material, such as conductive rubber, acting as high impedance of approximately 5 through 10 MΩ. Accordingly, when the ESD contact protrusions 61*a* and 61*b* come in contact with the EMI contact portions 21*a* and 21*b*, the EMI shield 113 and the EMI shield 143 are electrically connected to each other through a high-impedance conductor. In addition, the high impedance herein means that a value of impedance with respect to a pulse current caused by ESD is high, and the high impedance is constituted by only a resistive element and/or constituted by impedance having inductive reactance as a main component. The ESD contact protrusions 61*a* and 61*b* may be configured by forming protrusions per se with a high-impedance material, by coating a high-impedance material on surfaces of protrusions formed of a good conductor, or by inserting an impedance element between the protrusions and the EMI shield 143, as long as high impedance is obtained between the ESD contact portions 21*a* and 21*b* and the EMI shield 143. On the contrary, the ESD contact protrusions 61*a* and 61*b* may be formed of a good conductor and a high-impedance material may be arranged on a side of the ESD contact portions 21*a* and 21*b*.

Figure 3:
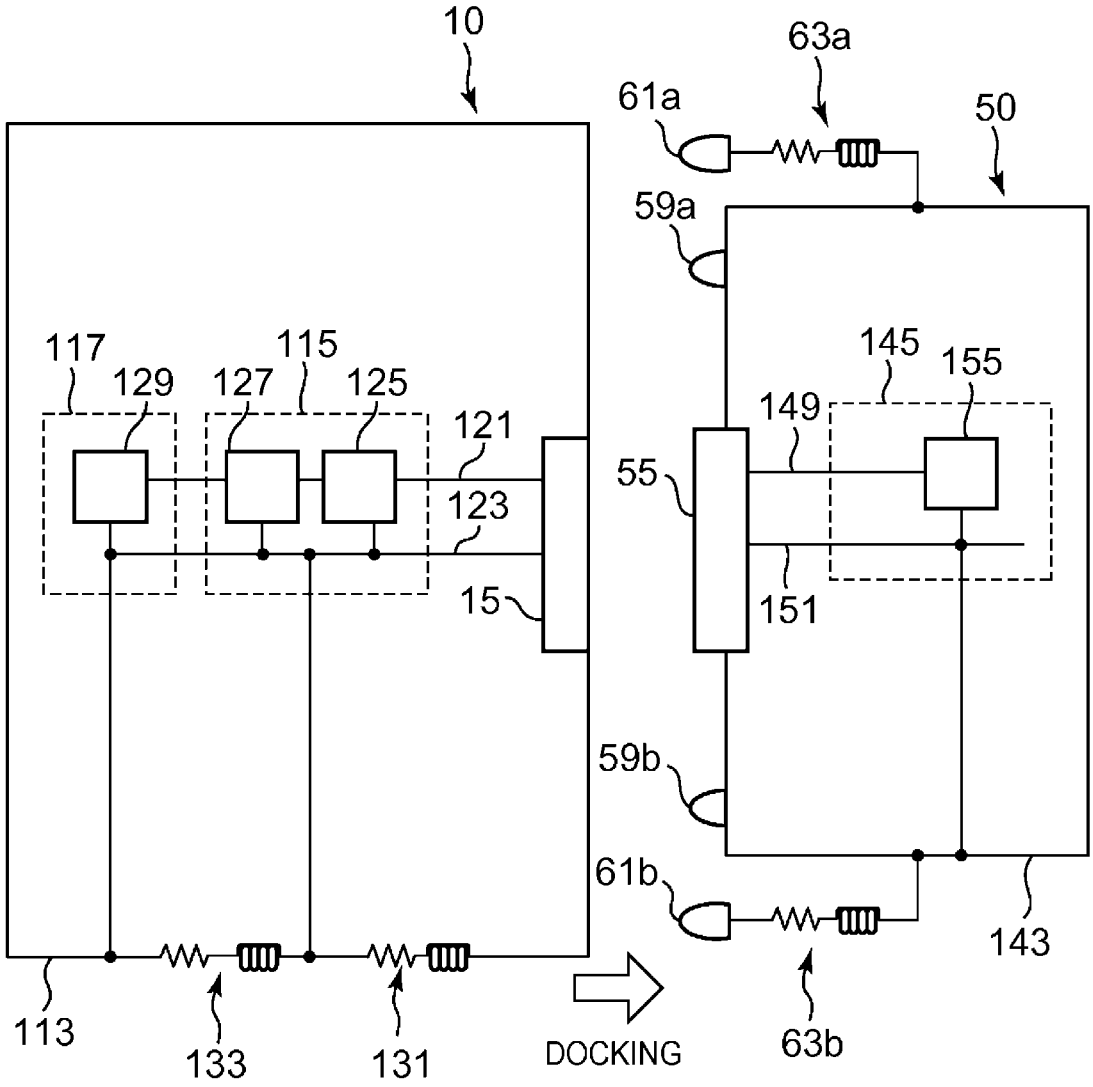
FIG. 3 is a circuit diagram illustrating connection states of EMI connecting protrusions, ESD contact protrusions, and connectors when a notebook PC is docked with a docking station in an embodiment of the present invention.

FIG. 3 is a circuit diagram illustrating a state when the notebook PC 10 is hot docked with the docking station 50. In FIG. 3, the same components as in FIG. 5 are denoted by the same reference numerals, and an explanation thereof will be omitted for the simplicity. FIG. 3 is different from FIG. 5 in that the ESD contact protrusions 61*a* and 61*b* are connected to the EMI shield 143 through high-impedance elements 63*a* and 63*b*, respectively. In addition, when the notebook PC 10 is hot docked with the docking station 50, the ESD contact protrusions 61*a* and 61*b* and the EMI shield 113 first come in contact with each other to allow ESD through the ESD contact protrusions 61*a* and 61*b*. Subsequently the EMI connecting protrusions 59*a* and 59*b* and the EMI shield 113 are connected to each other. In order to stably perform hot docking, pins of the connectors 15 and 55 are formed such that connection between the power supply line 121 and the power supply line 149 are performed earlier than the connection between the power supply earth line 123 and the power supply earth line 151. Although the connection between the power supply earth line 123 and the power supply earth line 151 need to be performed after ESD contact, any connection may be first performed before EMI connection.

Since the ESD contact protrusions 61*a* and 61*b* protrude farthest from the upper surface of the docking station 50, the ESD contact portions 21*a* and 21*b* and the ESD contact protrusions 61*a* and 61*b* are first brought close to each other when the connector 15 and the connector 55 are brought to each other while hot docking the notebook PC 10, on which electrostatic charge is carried, with the docking station 50. However, since aerial discharge does not occur in the ESD contact protrusions 61*a* and 61*b* due to action of the high-impedance elements 63*a* and 63*b*, the ESD contact portions 21*a* and 21*b* and the ESD contact protrusions 61*a* and 61*b* eventually come in physical contact with each other. Then, the electrostatic charge moves from the EMI shield 113 to the EMI shield 143. The movement direction of the electrostatic charge and the direction of a current generated by ESD depend on the polarity of the electrostatic charge which is carried. However, since the impedance elements 63*a* and 63*b* have large values, the movement of electrostatic charge is slow and a peak value of a conduction current generated by ESD is suppressed. According to this configuration, it is possible to remove the electrostatic charge which is carried on the notebook PC 10 while causing an impulse-shaped large current, which is generated by ESD, not to flow through the EMI shield 113.

After the electrostatic charge carried on the notebook PC 10 moves to the docking station 50 to be removed, the EMI connecting protrusions 59*a* and 59*b* and the EMI shield 113 are connected to each other. At this point in time, an electric potential difference between the EMI shield 113 and the EMI shield 143, which is caused by the electrostatic charge, is already decreased. Accordingly, since ESD which generates a large impulse current in the EMI connecting protrusions 59*a* and 59*b* does not occur, electronic components inside the notebook PC 10 and the docking station 50 are protected from ESD. Since the EMI connecting protrusions 59*a* and 59*b* are connected to the EMI shields 113 and 143 at two different places on a plane, respectively, it is possible to make an electric potential difference small even in case of a high-frequency current. As a result, an antenna effect is suppressed. Thereafter, the connector 15 and the connector 55 come in contact with each other, such that the signal earth line 123 and the signal earth line 151 are electrically connected to each other and then the signal line 121 and the signal line 149 are electrically connected to each other. Thus, hot docking is completed.

In the structure described in FIGS. 1 to 3, a user can hot dock the notebook PC 10 with the docking station 50 in such a manner that the ESD contact protrusions 61*a* and 61*b* and the EMI shield 113 are brought into contact with each other to perform ESD and then EMI connection is established. In addition, after the EMI connection is established after performing the ESD contact and the notebook PC 10 and the docking station 50 are completely docked with each other, the ESD contact protrusions 61*a* and 61*b* and the EMI shield 113 may be in contact with each other or may be separated from each other. Although a peak value of a conduction current can be suppressed if the impedances of the impedance elements 63*a* and 63*b* are increased, a time taken to move electrostatic charge is increased. Values which allow ESD not to occur through the air are determined as minimum values of the sizes of the impedance elements 63*a* and 63*b* for preventing failure caused by ESD, and values which allow electrostatic charge to be removed to the extent that failure caused by ESD, which occurs through the EMI connecting protrusions 59*a* and 59*b*, does not occur at the time of EMI connection are determined as maximum values thereof. Thus, values between the minimum and maximum values can be selected as the sizes of the impedance elements 63*a* and 63*b* for preventing the failure caused by ESD.

Figure 4A:
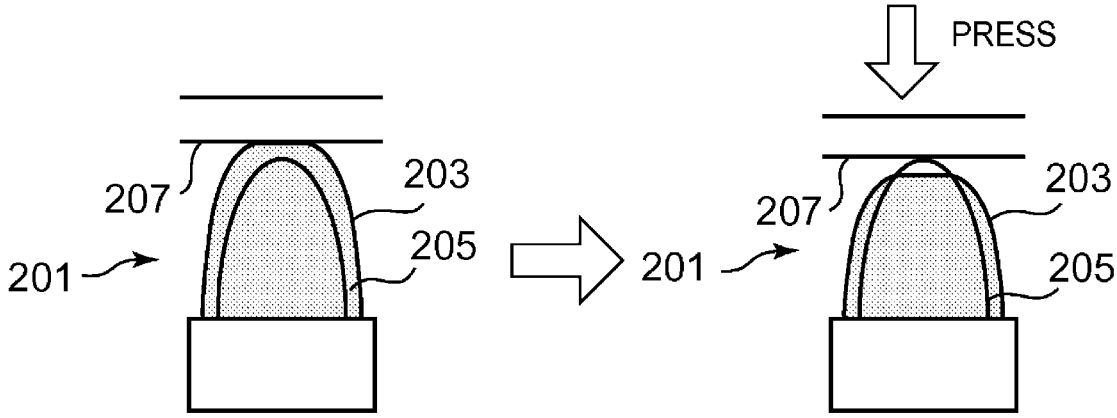
FIG. 4A is a cross-sectional drawing illustrating an example of integral ESD contact and EMI connecting protrusions.
Figure 4B:
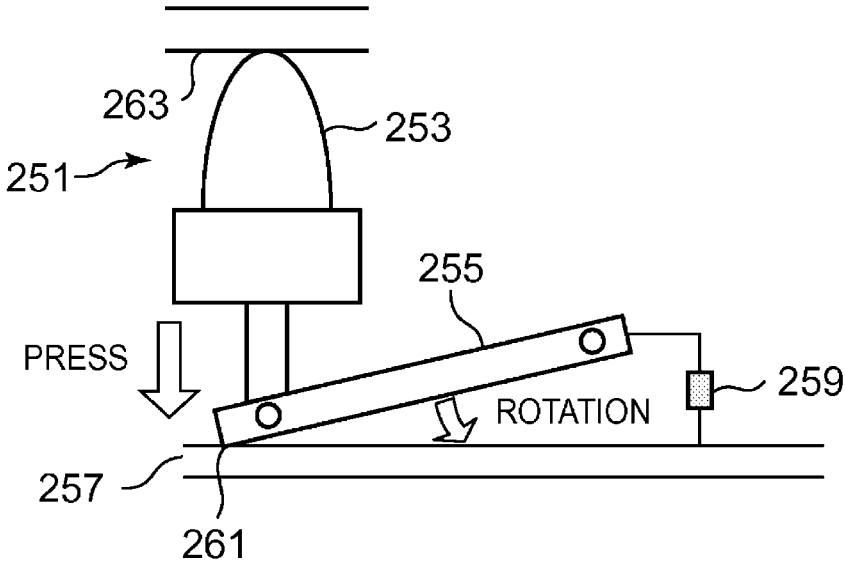
FIG. 4B is a side view drawing illustrating an example of integrated an ESD contact and an EMI connecting protrusion.

In the example described in FIGS. 1 to 3, the ESD contact protrusions 61*a* and 61*b* are formed separately from the EMI connecting protrusions 59*a* and 59*b*. In this case, there is a possibility that aerial discharge will occur in the EMI connecting protrusions 59*a* and 59*b* earlier than the ESD contact protrusions 61*a* and 61*b* due to the positional relationship or the position of the notebook PC 10 when the notebook PC 10 is brought closer to the docking station 50. In order to prevent this, the ESD contact protrusions 61*a* and 61*b* and the EMI connecting protrusions 59*a* and 59*b* maybe integrally formed. FIGS. 4A and 4B are cross-sectional and side view drawings respectively illustrating an example of the structure of such a protrusion. A protrusion 201 shown in FIG. 4A has an inside protrusion 205, which is formed of a good conductor, such as metal, on an inner side of an outside protrusion 203 formed of a high-impedance material, such as conductive rubber. When the protrusion 201 is pressed against a connecting surface 207 of an EMI shield provided in a housing of a notebook PC, the outside protrusion 203 first comes in contact with the connecting surface 207, and then electrical connection is established between the protrusion 201 and the connecting surface 207 with a high impedance therebetween. In this state, the inside protrusion 205 is not in contact with the connecting surface 207. Then, when the protrusion 201 is further pressed against the connecting surface 207 while being in contact with the connecting surface 207, the outside protrusion 203 withdraws exposing the inside protrusion 205, such that the inside protrusion 205 comes in contact with the connecting surface 207. With this structure, the EMI connection is established after the ESD contact is performed.

In addition, a protrusion 251 shown in FIG. 4B has a structure in which a protrusion 253 formed of a good conductor is held by a lever 255 formed of a good conductor and an end of the lever 255 is pushed when the protrusion 253 is pressed and pushed against a connecting surface 263 of an EMI shield provided in a housing of a notebook PC. The lever 255 and an EMI shield 257 are connected to each other with a high-impedance element 259 interposed therebetween. In addition, when one end of the lever 255 is pressed, the lever 255 rotates to thereby make the end of the lever 255 and the EMI shield 257 come in contact with each other at a contact point 261. Thus, at a point of time right after the protrusion 253 has come into contact with the connecting surface 263, electrical connection between the EMI shield 257 and the connecting surface 263 becomes ESD contact through the high-impedance element 259 because the lever 255 and the EMI shield 257 are not in contact with each other yet. Then, when the contact protrusion 253 is further pushed against the connecting surface 263 while the contact protrusion 253 is being in contact with the connecting surface 263, the lever 255 and the EMI shield 257, both of which are good conductors, come in contact with each other at the contact point 261, such that EMI connection is made between the EMI shield 257 and the connecting surface 263. In the structures shown in FIGS. 4A and 4B, since an ESD contact portion and an EMI connecting portion are formed at the same place on a plane, it is possible to prevent a situation in which aerial discharge may occur in the EMI connecting portion depending on the position of the notebook PC 10 at the time of hot docking.

If one skilled in the art understands the principle of the present invention in which ESD contact between electronic devices, which need an EMI connection, is performed in a high-impedance state and then an electrically reliable EMI connection is performed between the electronic devices, one skilled in the art might be able to easily constitute similar structures other than the examples introduced above. In addition, the present invention may also be applied to a case of connecting a precision electronic device, which requires protection of internal electronic components against EMI, to another precision electronic device, which also requires protection against EMI, without being limited to the connection between the notebook PC and the docking station.

While the present invention has been described with reference to the specific embodiment shown in the drawings, it is needless to say that the present invention is not limited to the embodiment described in the drawings but known configurations may also be adopted as long as the effects of the present invention are obtained. For example, the present invention can be used in an electronic device to which a peripheral device can be connected.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A connecting structure of a second electronic device, the connecting structure comprising:

a second electromagnetic interference (EMI) shield;

a second signal line enclosed by the second EMI shield and connected to a first signal line when hot docking with a first electronic device comprising a first EMI shield, a processor enclosed by the first EMI shield, the first signal line enclosed by the first EMI shield and connected to the processor, and a first signal earth line enclosed by the first EMI shield and connected to the processor;

a second signal earth line enclosed by the second EMI shield and connected to the first signal earth line when hot docking;

an EMI connecting portion connected to the second EMI shield and comprising a good conductor connected to the first EMI shield when hot docking; and an electrostatic discharge (ESD) contact portion comprising conductive rubber formed outside of the EMI connecting portion and co-axial with the EMI connecting portion, connected to the second EMI shield, higher in impedance than the EMI connecting portion, and coming in contact with the first EMI shield earlier than the EMI connecting portion at the time of hot docking and withdrawing to expose the EMI connecting portion in response to the ESD contact portion being pressed against the first EMI shield such that the EMI connecting portion comes in contact with the first EMI shield.

2. The connecting structure according to claim 1, wherein when the first electronic device is hot docked with the second electronic device, the first signal earth line and the second signal earth line are connected to each other after the ESD contact portion and the first EMI shield are in contact with each other and the first signal line and the second signal line are connected to each other after the first signal earth line and the second signal earth line are connected to each other.

3. The connecting structure according to claim 1, wherein the first EMI shield and the second EMI shield apply reference potentials to the first electronic device and the second electronic device, respectively, and the first signal earth line is connected to the first EMI shield and the second signal earth line is connected to the second EMI shield.

4. The connecting structure according to claim 1, wherein an impedance value, which does not allow aerial discharge when the ESD contact portion is brought closer to the first EMI shield in a condition where the first electronic device is electrically charged while a user is holding the first electronic device, is selected as an impedance of the ESD contact portion.

5. The connecting structure according to claim 1, wherein the ESD contact portion has an inductive reactance.

6. The connecting structure according to claim 1, wherein the first electronic device includes a first interface connector to which the first signal line and the first signal earth line are connected;

the second electronic device includes a second interface connector which can connect to the first interface connector and to which the second signal line and the second signal earth line are connected; and the EMI connecting portion and ESD contact portion are provided at a plurality of positions spaced apart from the second interface connector.

7. A function expansion device comprising:

a second EMI shield;

a second signal line enclosed by the second EMI shield;

a second signal earth line enclosed by the second EMI shield;

a second interface connector to which the second signal line and the second signal earth line are connected;

an EMI connecting portion connected to the second EMI shield and comprising a good conductor connected to a first EMI shield when hot docked with a portable computer comprising the first EMI shield, a first signal line enclosed by the first EMI shield, a first signal earth line enclosed by the first EMI shield, and a first interface connector to which the first signal line and the first signal earth line are connected; and an ESD contact portion comprising conductive rubber formed outside of the second interface connector and co-axial with the second interface connector, connected to the second EMI shield, higher in impedance than the EMI connecting portion, and coming in contact with the first EMI shield earlier than the EMI connecting portion at the time of hot docking and withdrawing to expose the EMI connecting portion in response to the ESD contact portion being pressed against the first EMI shield such that the EMI connecting portion comes in contact with the first EMI shield.

8. A method comprising:

activating a portable computer;

bringing the portable computer closer to a function expansion device with the portable computer active;

performing ESD contact between an ESD contact portion connected to an EMI shield of the portable computer and an EMI shield of the function expansion device, the ESD contact portion comprising conductive rubber formed outside of an EMI connecting portion and co-axial with the EMI connecting portion;

withdrawing the ESD contact portion to expose the EMI connecting portion in response to the ESD contact portion being pressed against the EMI shield of the function expansion device such that the EMI connecting portion comes in contact with the first EMI shield;

performing EMI connection between the EMI connecting portion and the EMI shield of the function expansion device subsequent to withdrawing the ESD contact portion.

9. The method according to claim 8, further comprising:

connecting a signal earth line of the active portable computer and a signal earth line of the function expansion device to each other subsequent to performing the ESD connection.

10. The method according to claim 9, further comprising:

connecting a signal line of the active portable computer and a signal line of the function expansion device to each other subsequent to connecting the signal earth lines.

* * * * *